US008474395B2

(12) United States Patent
Meredith et al.

(10) Patent No.: US 8,474,395 B2
(45) Date of Patent: Jul. 2, 2013

(54) DEVICE FOR LINING OR REPAIRING OFFSET CHIMNEYS INCLUDING A RETICULATED CENTERING DEVICE WITH AN UPPER AND LOWER CENTERING GUIDE

(76) Inventors: John E. Meredith, Richmond, IN (US); Thomas J. Urban, Fairfield, IA (US)

( * ) Notice: Subject to any disclaimer, the term of this patent is extended or adjusted under 35 U.S.C. 154(b) by 262 days.

(21) Appl. No.: 12/880,690

(22) Filed: Sep. 13, 2010

(65) Prior Publication Data

US 2011/0061590 A1 Mar. 17, 2011

Related U.S. Application Data

(60) Provisional application No. 61/241,540, filed on Sep. 11, 2009.

(51) Int. Cl.

| | |
|---|---|
| ***B05C 1/00*** | (2006.01) |
| ***B05C 3/02*** | (2006.01) |
| ***F23J 3/00*** | (2006.01) |
| *B05D 7/22* | (2006.01) |
| *B05D 3/00* | (2006.01) |
| *B05D 1/28* | (2006.01) |

(52) U.S. Cl.
USPC ..... 118/254

(58) Field of Classification Search
USPC ..... 118/105, 214, 254, DIG. 10; 425/11, 425/90; 264/30, 36.16; 52/74.1; 15/406
See application file for complete search history.

(56) References Cited

U.S. PATENT DOCUMENTS

| | | | | |
|---|---|---|---|---|
| 1,951,221 | A * | 3/1934 | Tate | 118/408 |
| 2,026,470 | A * | 12/1935 | Haskins et al. | 425/11 |
| 2,106,004 | A * | 1/1938 | Inglee | 204/625 |
| 3,525,111 | A * | 8/1970 | Von Arx | 15/104.061 |
| 3,885,521 | A * | 5/1975 | von Arx | 118/105 |
| 4,137,623 | A * | 2/1979 | Taylor | 29/433 |
| 4,252,763 | A * | 2/1981 | Padgett | 264/133 |
| 4,308,824 | A * | 1/1982 | Muta et al. | 118/713 |
| 6,481,757 | B1 * | 11/2002 | Pao et al. | 285/125.1 |
| 7,029,254 | B2 * | 4/2006 | Gozu et al. | 425/11 |
| 7,112,350 | B1 * | 9/2006 | Roberts | 427/476 |
| 2005/0013889 | A1 * | 1/2005 | Endre | 425/90 |
| 2008/0094428 | A1 * | 4/2008 | Otis et al. | 347/1 |
| 2009/0291204 | A1 * | 11/2009 | Meredith et al. | 427/140 |
| 2010/0326352 | A1 * | 12/2010 | Hart et al. | 118/317 |

OTHER PUBLICATIONS

Chimney flue installation, Ornamental, Aug. 24, 2009.
Landy Vent, Method of Installation from http://www.landyvent.co.uk/en/installation.htm, Aug. 24, 2009.

* cited by examiner

*Primary Examiner* — Dah-Wei Yuan
*Assistant Examiner* — Karl Kurple
(74) *Attorney, Agent, or Firm* — Woodard, Emhardt, Moriarty, McNett & Henry LLP

(57) ABSTRACT

A device for repairing or relining an offset chimney includes a spreader assembly for spreading a repair material on the interior walls of a chimney as the device is pulled up the chimney, a pull assembly for pulling the device through the chimney, and an optionally reticulated centering device for keeping the portion of the pull assembly directly above the spreader assembly away from the chimney walls when the spreader blade assembly is moved through a chimney offset.

4 Claims, 10 Drawing Sheets

DEVICE FOR LINING OR REPAIRING OFFSET CHIMNEYS INCLUDING A RETICULATED CENTERING DEVICE WITH AN UPPER AND LOWER CENTERING GUIDE

REFERENCE TO RELATED APPLICATIONS

This application claims the benefit of U.S. Provisional Patent Application Ser. No. 61/241,540, filed Sep. 11, 2009, the entire contents of which is hereby incorporated herein by reference.

FIELD OF THE INVENTION

The present invention relates generally to devices for lining or repairing a chimney, and more particularly to a device for lining or repairing chimneys that have an offset portion.

BACKGROUND TO THE INVENTION

Masonry chimneys are commonly constructed with an inner liner of clay tiles designed to keep the heat of the flue gasses inside the chimney. This prevents the chimney from overheating and potentially igniting nearby combustible material, such as the framing and walls of the building to which the chimney is attached. The liner also keeps harmful flue gasses, moisture, smoke, creosote, and other combustion products from seeping through the chimney and leaking into the building. A secure lining system is therefore critical to ensure the safety of the chimney and the health of the occupants of the attached structure, and is therefore required by most modern building codes.

If a liner was not installed in a chimney system, or if the original liner cracks, crumbles or deteriorates over time, the liner should be repaired or a new liner should be installed. One common way to reline a chimney has been with stainless steel relining pipe. With this method a round or oval stainless steel liner is installed in the chimney. However, metal chimney liners such as stainless steel are susceptible to attack by certain acids and chemicals that are the byproducts of combustion (flue gases). Also, metal chimney liners are prone to disfiguration when subjected to high temperatures such as may be faced during a chimney fire.

Another method for relining or repairing a chimney is with a flowable material that is applied to the chimney walls and cures to form a cast-in-place barrier. The flowable material may be applied using a round or oval bladder (or a series of bladders for larger openings) that is centered in the chimney before the flowable material is subsequently poured or pumped around the inflated form. After the material has cured, the bladder is deflated and removed, leaving the new masonry material as a liner in the chimney.

More recently and preferably, the flowable material may be applied using a "plunger" tool that is positioned at the bottom of the chimney and some of the flowable material is poured thereon. The plunger is then pulled upward with a winch, and an outwardly extending plunger blade pushes material into and onto the chimney wall and scrapes excess material from the surface. Additional flowable material is added as the plunger advances up the chimney.

In addition to the above, it has been estimated that nearly half of all masonry chimneys that are lined with sections of clay flue tile have at least one joint (the juncture between the each section) that has deteriorated and needs to be replaced. This can create a potentially hazardous condition for the occupants. The purpose of a chimney is to contain and convey the products of combustion to the outside. If the chimneys liner contains gaps and voids, it can no longer be relied on to function for its intended purpose.

All nationally recognized building codes (National Fire Protection Association 211 Standard for Chimneys & International Residential Building Code-R1001.9 Flue lining installation) call for flue liners to be joined together and sealed with a non-water-soluble refractory cement that meets ASTM C199 medium duty classification. Unfortunately, it has been found that during the original construction, builders often use standard mortar to lay or seal flue tile sections. Because standard mortar is water soluble and not meant for high heat applications, joints constructed with standard mortar may deteriorate more rapidly than sections joined together and sealed with refractory mortar.

The problems of relining or repairing chimneys, including repairing mortar joints between adjacent chimney sections, are even more significant when the chimney is one with an offset portion. In an offset chimney, the flue is not a straight shaft, and instead bends or angles to one side or the other before resuming its vertical path. This makes the use of a metal liner system difficult, and has also made the application of a flowable liner material difficult if not impossible. Moreover, the clay flue tiles must often be removed in order to install a properly-sized metal liner system. Since it has been estimated that thirty to forty percent of all chimneys have bends or offsets in them that makes maintenance with existing tools difficult, a significant number of offset chimneys deteriorate every year and cannot be inexpensively repaired or relined using existing technologies.

A need therefore exists for a method and device for relining and/or repairing chimneys that have an offset portion. The present invention addresses that need.

SUMMARY OF THE INVENTION

In one aspect of the present invention there is provided a device for applying a flowable repair material to the interior walls of a chimney. The device preferably includes a spreader blade attached to a cable that may be pulled by a winch. The spreader blade is sized to be slightly larger than the size of the chimney interior so that when the blade is in place a flowable chimney linier/repair material may be poured onto the device from above and the device will hold most of the material and keep it from dropping down below the blade. However as the spreader blade is pulled upward through the chimney, a thin coating of the material oozes past the flexible blade rim and coats the chimney wall to repair cracks in the chimney or provide a liner material.

The spreader blade is preferably topped by a spreader head that slopes outward toward the rim of the spreader blade to facilitate movement of the flowable material to the outside of the blade. The height of the spreader head may be several inches, but it is preferably shallow enough to avoid blocking the device as is passes though bends in an offset chimney. The spreader blade and spreader head may be provided as a one-piece or multi-piece assembly. The spreader head is preferably made of a material that is less flexible than the material used for the rim of the spreader blade.

A centering device extends vertically above the spreader to keep the device centered and to prevent it from becoming stuck in the bends of an offset chimney. The centering device may be made of a plurality of rods that extend from the spreader blade to a hub or ring attached to the cable above the spreader. In the most preferred embodiments the centering device is reticulated and comprises a first set of rods that act as an upper centering guide, and a second set of rods that act as a lower centering guide. The two centering guide sections cooperate as a reticulated centering device that allows the guide to "bend" as the device moves through the bends of an offset of a chimney. The centering device preferably extends for a distance or one or two feet above the spreader blade and/or head assembly.

A pull assembly connects the spreader blade and/or head assembly to a cable used to pull the device. The pull assembly preferably extends from the spreader blade and/or head assembly to the top of the centering device. The bottom of the pull assembly connects, directly or indirectly, to the spreader blade and/or head assembly, while the top of the pull assembly connects, directly or indirectly, to the cable that pulls the device through the chimney. Preferably both the bottom and the top connections are at or near the horizontal center of the device.

A guide wheel may be used to hold the cable away from the chimney walls, and thereby to facilitate centering the pull assembly as it advances up a chimney. The guide wheel is preferably attached to a rod such as a chimney sweep rod so that it can be lowered into the chimney from above.

When the device is pulled upward in the chimney, some repair material flows past the spreader blade rim and the spreader blade controls the thickness of the layer being applied to the wall and presses the repair material into any cracks or holes in the chimney interior (and particularly in defective or deteriorated joints). The guide wheel and the centering device keep the spreader blade centered, and facilitate advancing the spreader through bends or offsets in the chimney flue.

DESCRIPTION OF THE PREFERRED EMBODIMENTS

Figure 1:
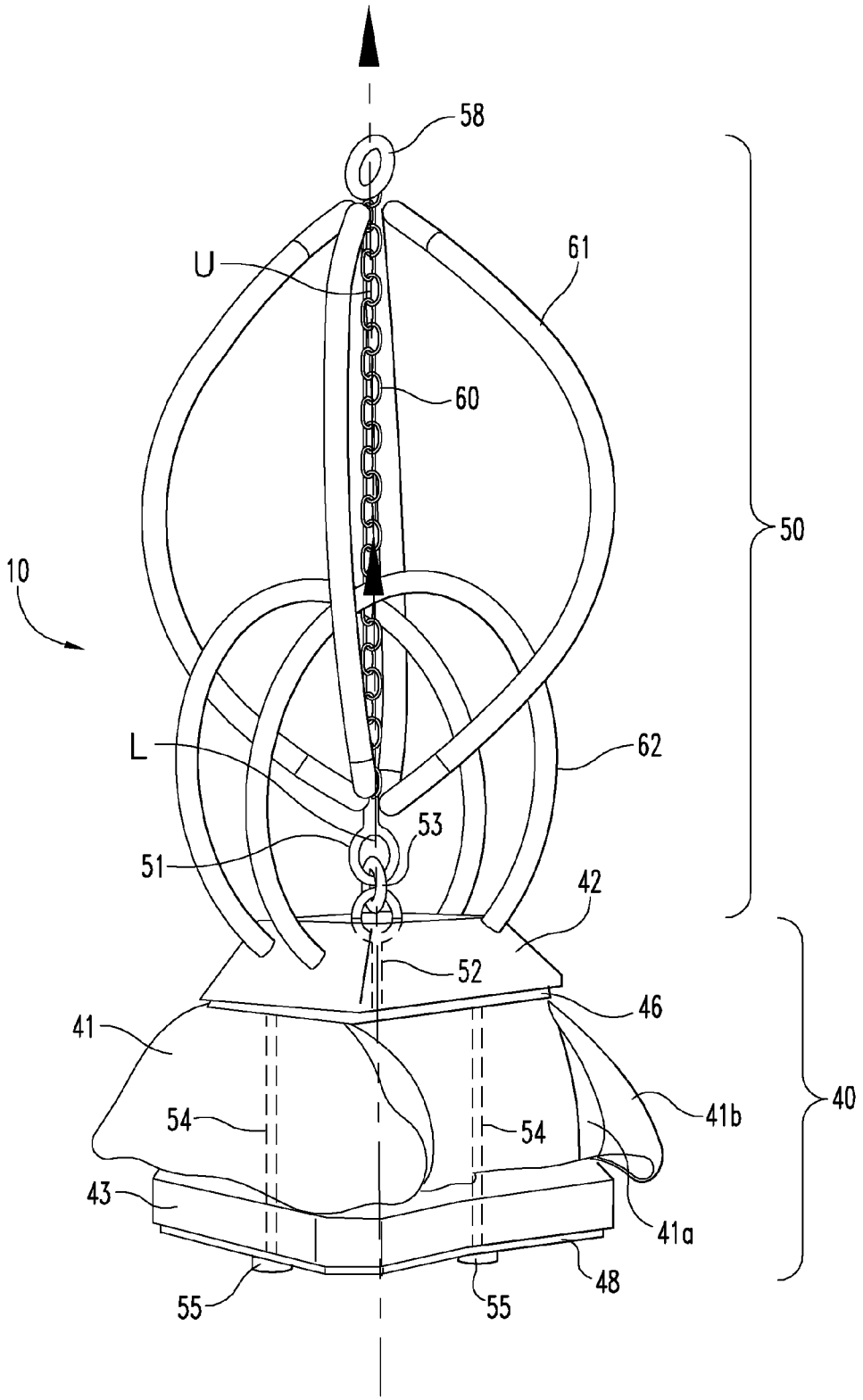
FIG. 1 shows one preferred embodiment of the inventive spreader device, without the guide wheel portion.

For the purposes of promoting an understanding of the principles of the invention, reference will now be made to certain embodiments and specific language will be used to describe the same. It will nevertheless be understood that no limitation of the scope of the invention is thereby intended. Instead, the claims of the application are intended to cover all alterations and further modifications in the illustrated invention, and such further applications of the principles of the invention disclosed herein, as would normally occur to one skilled in the art to which the invention relates.

One aspect of the present invention provides a device and method for lining or repairing the inside of a chimney having an offset. The device comprises a spreader that may be pulled by a cable, wherein the spreader is sized to be just larger than the interior of a chimney to be repaired. A centering device, which may be made of rods that allow repair material to flow therethrough, extends above the spreader to keep the spreader properly positioned in the flue as the spreader advances through the offset.

The device is used to apply a repair material (or a liner material) to the side walls of a chimney that has an offset portion. The repair/liner material may be any mortar-like material, including particularly a non-water-soluble, medium duty refractory cement. In the inventive method, the repair/liner material is poured from above so that it flows down to the spreader. A reservoir of material covers the top of the spreader and provides sufficient head pressure to push a relatively thin coating of the material past the spreader blade rim. The spreader is then pulled up, thereby spreading the material evenly over the chimney walls and pushing the material into any cracks or spaces in or between the chimney tiles.

While additional applications are intended to be within the scope of the present invention, the materials and methods of the present invention find particular utility with field-installation into new or existing masonry chimneys that are used for the natural draft venting of Category I gas-fired, Type L vented oil-fired, or solid-fuel-fired residential-type appliances in which the maximum continuous flue-gas outlet temperatures do not exceed 1000° F. (538° C.).

In the embodiment described in the following description, and illustrated in the accompanying drawings, the chimney tiles are substantially rectangular or square. However, it is to be appreciated that the invention may be provided for chimneys of virtually any shape, including rectangular (including square), round, and oval chimney tiles, with the corners of rectangular embodiments optionally being rounded such as illustrated herein. Similarly, while reference may be made herein to chimney "walls," it is to be appreciated that a round or oval chimney may be viewed as having only one "wall" that extends the entire length of the chimney.

1. The Spreader Assembly.

The spreader assembly of the inventive device includes a spreader blade, and also optionally includes spreader head. One or more support members that support the spreader blade and/or spreader head may additionally be provided. At least one of the support members may also provide a connection for attachment to a cable that pulls the blade.

The spreader blade is constructed and sized so as to be effective for applying a chimney repair or liner material over the inner wall or walls of a chimney as the spreader blade is pulled through the chimney. Preferably, the spreader blade effective for spreading a chimney repair material over the entire inner wall of a chimney in one pass as the spreader blade is pulled through the chimney. That is, the spreader blade is preferably sized to contact all four walls of a rectangular chimney, or the entire circumference of a round or oval/elliptical chimney, as the blade is being pulled through the chimney.

The spreader blade controls the amount of repair/liner material that is applied to the chimney walls, and thereby controls the thickness of the layer of repair/liner material. The spreader blade also may push repair/liner material into any holes or cracks that need to be filled.

In one embodiment the spreader blade is made of a flexible material that is cut to a size and shape that generally matches, but is slightly larger than, the shape of the chimney. For example, a spreader blade having a width/length that is about 1" wider/longer than the opening of the chimney may be used so that the spreader folds under about ½" all around when in use and applies a steady, even pressure to apply repair material to the chimney wall(s).

The spreader blade is preferably made of a material that is flexible enough to adapt to any chimney shape irregularities, yet firm or rigid enough to push repair material into the spaces that need to be repaired or filled. In one embodiment an open cell polyurethane foam may be used. In another embodiment a four- pound cross-linked polyethylene open cell foam, or the functional equivalent, may be used. The foam material may be wrapped in a plastic sheet material if necessary to avoid having the repair/liner material soak into or adhere to the spreader blade.

A spreader head may be provided above the spreader blade to direct the repair material to the outside rim of the spreader blade where it can be spread onto the walls. The spreader head may also provide an interface for the centering device. The spreader head preferably slopes downward from a higher point at the center of the device to a lower point at its outside edges. When the repair/lining material is dropped down onto the spreader assembly from above, the shape of the spreader head helps direct material down and to the sides of the assembly. The height of the spreader head is preferably between about two and about six inches, with a spreader head height of about four inches being preferred in some embodiments.

The spreader head is preferably made of a material that is stiff and rigid enough to direct repair to the rim of the spreader blade. In one embodiment a two-pound cross-linked closed cell polyethylene foam, or the functional equivalent, may be used. In another embodiment a closed cell polypropylene material is used for the spreader head.

In some embodiments the spreader blade and the spreader head may be provided as a unified construction. In that embodiment the upper portion may be a relatively rigid spreader head as discussed above, and the lower portion may be a somewhat more flexible spreader blade that can adjust in size and shape as chimney irregularities are encountered.

Additionally, in some embodiments either the spreader blade and/or the spreader head may be provided as a multi-part construction. For example, the spreader blade may be provided as two spreader blades that cooperate to control the amount and thickness of repair/liner material that is applied to the chimney walls. In one embodiment a first, relatively rigid material such as a two-pound cross-linked polyethylene closed cell foam may be used for one spreader blade portion, while a relatively flexible material such as an open cell polyurethane foam is used for another spreader blade portion. The more rigid blade portion does not contact the chimney wall but provides support to the spreader blade, while the more flexible blade portion contacts the chimney wall and spreads the repair material.

The spreader blade(s) may be supported by one or more support members. In one embodiment upper and lower support members are used to sandwich the spreader blade(s) and provide a base for attachment of the cable. For example, upper and/or lower support plates may be used. The upper plate may be a relatively rigid material such as a 10 gauge steel plate. The upper plate may be made of a somewhat less rigid material such as a bendable plastic. The use of a less rigid material for the lower plate allows the lower plate to flex and deform slightly and avoid being caught on irregularities in the chimney wall.

Additionally or alternatively, upper and/or lower foam supports may be used. Here too, at least the lower foam support is preferably made of a material with enough ability to bend or flex to avoid being caught on irregularities in the chimney wall.

Regardless of whether one or more support members are used, the support members should support and stabilize the spreader blade and/or head to help maintain the rigidity necessary to effectively apply the liner or repair material.

Associated hardware such as top and bottom retainer plates may be used to hold the various components together. For example, the spreader head, spreader blade, and spreader blade support plates may be held together by one or more rods that pass through the components. In one embodiment an eye bolt is used to connect multiple support plates, with the shank of the bolt passing through an upper plate above the spreader blades to a lower plate below the spreader head and/or the spreader blade, and the upper end of the bolt terminating with an eye to facilitate attachment to the cable.

2. The Centering Assembly.

A centering assembly is provided above the spreader assembly to center the device as it is pulled through the bends of an offset chimney. The centering assembly preferably includes a pull assembly and a series of rods that extend upward from the spreader blade for a distance of between about twelve- to twenty-four inches. That distance is generally enough to facilitate movement of the device through the bends of a chimney offset in common residential chimneys.

The pull assembly is provided to facilitate pulling the device through the bends of an offset chimney. In one embodiment the pull assembly connects the spreader blade and/or head assembly to a cable used to pull the device. The pull assembly preferably extends upward from the spreader blade and/or head assembly to a connection point twelve- to twenty-four inched above the top of the spreader assembly. The bottom of the pull assembly connects, directly or indirectly, to the spreader blade and/or head assembly, while the top of the pull assembly connects, directly or indirectly, to the cable that pulls the device through the chimney. Preferably both the bottom and the top connections are at or near the horizontal center of the device.

The pull assembly allows the section of cable or chain directly above the spreader blade and/or head to be centered by a centering device to facilitate movement through the bends of an offset chimney. Accordingly, the pull assembly may be a separate and distinct length of cable or chain, or it may simply be the lowermost portion of the cable or chain that is connected to the winch or other pulling device. As described in more detail below, the pull assembly is the portion of the cable or chain (or other pulling structure) that is directly above the spreader blade and/or head but within the distance spanned by the centering device.

In the most preferred embodiments the pull assembly comprises a flexible pull such as a chain or a cable. Rings or loops or some other structure for attachment are preferably provided at one or both ends of the chain.

A series of rods is provided around the pull assembly to center the portion of the flexible pull directly above the spreader blade and/or head as the device is pulled through the bends of an offset chimney. The centering rods preferably extend upward from the spreader blade for a distance of between about twelve- to twenty-four inches. That distance is generally enough to facilitate movement of the device through the bends of a chimney offset in common residential chimneys.

The centering assembly may also include a series of rods that extend upward and surround the pull assembly. In one embodiment the centering rods comprise four centering rods that arc upward from the four corners of the spreader blade and connect to a locking connection on the cable above the top of the spreader assembly. When four rods are used as described herein, the centering assembly may have a smooth "bullet" or "bowed" or "blowfish" shape that prevents it from becoming snagged on corners of the chimney offset.

In another embodiment the centering assembly includes two or more sets of rods is a reticulated design, with an upper portion comprising a first set of centering rods in a "bullet" or "bowed" or "blowfish" shape, and the lower portion comprising a second set of rods in a shape effective to keep the device from catching on the corners of a chimney offset bend. The upper rods may be referred to as the upper centering guide or the upper bow rods in this description of the invention, while the lower rods may be referred to as the lower centering guide or the pulling head rods.

The lower set of centering rods may be connected to the spreader head so that the lower portion of the centering device remains aligned with the spreader head. The upper set of centering rods may be reticulated with respect to the lower rods and the spreader head so that the upper rods may turn a corner in a chimney offset before the lower rods have reached that corner. This allows the spreader head to stay substantially perpendicular to the walls of the chimney as the device is pulled upward and passes through a chimney offset bend.

The centering assembly preferably has an "open" structure to allow repair/liner material to flow through it. This allows the repair/liner material to be dropped from above and to flow to the rim of the spreader where it is applied to the chimney walls.

The centering assembly may be connected to the spreader assembly by attachment to a support plate. In one embodiment, the centering rods are attached to the four corners of a support plate below the spreader blade(s) and extend upward over the spreader head. In another embodiment the lower set of rods may be attached to a support plate or to the spreader head.

The upper portion of the centering rod assembly may be connected to a cable or chain that is sized to pull the device up through a chimney. In some embodiments a clamping or locking connection may be used. With a clamping/locking connection at one end of the rods, and a fixed connection at the other end of the rods, the height and width of the centering device may be adjusted and controlled by moving the clamp on the cable or removing links from a chain. This allows the size of the centering device to be controlled so that the device properly fits the chimney dimensions. Locking the centering rods in place also ensures that the device does not expand or collapse during use.

3. The Pulling Cable and Guide Wheel.

A cable may be used to pull the spreader assembly up through the chimney. The cable may be any cable effective for pulling the spreader assembly when loaded with chimney repair material. In one preferred embodiment the cable is a 3/16" vinyl coated wire rope (7×19 class strand core), although other cable sizes and types may be used. A winch may be used to pull the cable upward from above, and a guide line may be used to pull the device down into the chimney before use (thereby also loading the winch). In one embodiment the cable is connected to the spreader support plate by looping the cable through an eye bolt that passes through or is connected to the support plate.

A guide wheel may be used to maneuver the cable and hold it away from the chimney wall above the spreader device. The guide wheel preferably comprises a pulley attached to a long rod. An extender arm may be used to extend the pulley into the chimney when the rod is positioned against one of the walls. Preferably the extender arm extends enough to position the pulley about ⅔ of the distance away from the wall against which the rod has been stabilized. One or more stabilizing arms may be provided to stabilize the end of the device against the wall.

4. The Mortar Material.

The mortar material may be made of a blend of inorganic materials and inert aggregates together with a high temperature resin bonding agent. In one embodiment, the inert aggregates includes 50-80% $Al_2O_3$ and 10-40% $SiO_2$.

The flowable refractory material is preferably a high temperature, castable or moldable refractory coating capable of withstanding temperatures of at least 2100° F., more preferably at least 2300° F., and most preferably at least 2500° F. In some embodiments the flowable refractory material utilizes a (wet or dry) water based inorganic binder system that is resistant to hot gases, flame, water and chemical erosion. The flowable refractory material may be provided as a one- or a two-component system.

Preferably, the flowable refractory material comprises a material that will air dry in no more than 48 hours (at ambient temperatures of 10-35° C.) to a hard, abrasion resistant, non-water-soluble coating. In some embodiments the flowable refractory material may require increased air flow (fans, etc.) or increased temperatures (above 35° C.) to harden to an abrasion resistant coating. The flowable refractory material may comprise a material that can be fired at a low temperature (e.g., at least about 130° C. but typically no more than about 300° C.) for 24 to 48 hours until it is completely cured.

The flowable refractory material must be capable of adhering to the substrate to which it is applied, preferably without sagging, slumping, or flowing off of the surface when wet. In some preferred embodiments the flowable refractory material also provides good insulating properties and/or good thermal shock resistance. The flowable refractory material should have good chemical stability and not react with flue gasses or chimney components under normal (or even extreme) operating conditions.

The material should be viscous enough to form a slurry that can be easily applied yet evenly fills the cracks in, or spaces between, chimney tiles. If the material is too thick or too thin, the material may be difficult to apply or may not provide an adequate repair.

The mortar material may include a blend of inorganic minerals and binders, and may include ceramic fibers. The preferred material is based on the Eldfast™ material made by the Fa: J. Kikson Company, Vallentuna, Sweden. Eldfast™ is a ceramic material that does not contain cement or lime. It is composed of a blend of inorganic materials and inert aggregates together with a high temperature resin bonding agent in a powdered or liquid form. When these ingredients are mixed with water the result is a slurry that is flowable. It chemically sets and is water and acid resistant. The composition comprises 60-80% $Al_2O_3$ and 40-20% $SiO_2$.

5. The Method of Use.

In one method of use, a spreader head and reticulated centering rod assembly is inserted into the bottom of a rectangular, double offset chimney. The device is positioned so that the four upper bow rods press against the four corners of the chimney and the pulling head rods are parallel to the plane of the offset. With this position, the four upper bow rods will remain in the four corners of the chimney as the device passes through an offset, and the lower pulling head rods will slide against the upper and lower walls of the offset bend. A winch is positioned at the top of the chimney and is attached to one end of a cable. The cable is lowered into the chimney and is attached to the spreader head and centering rod assembly. The guide wheel is lowered until it is positioned just above the chimney offset and is maneuvered to hold the cable away from the wall. The cable passes over the guide wheel, and the rear portion of the guide wheel assembly presses against the wall. Preferably, the arm supporting the guide wheel assembly is adjusted prior to use so that the guide wheel is positioned approximately ⅔ of the distance from the supporting wall.

The spreader is then pulled upward for a short distance to ensure that the rim of the spreader blade is curled under. The repair/liner material is then poured in from the top chimney opening. Sufficient material is provided to fill a space of six to eighteen inches above the spreader head. It is important that there is enough material to provide at least about six inches or material to the highest part of the spreader blade when the spreader blade is angled to pass through an angled portion of a chimney offset. This provides sufficient head pressure to push the material over the spreader blade and onto the walls.

As the device begins to reach the first (lower) bend of the chimney offset, the upper bow rods of the centering device will "turn" into the lower (angled) offset portion before the lower rods of the pulling head reach the turn. Similarly, the lower pulling head rods will "turn" into the lower (angled) offset portion before the spreader head portion of the assembly reaches the turn. As the cable is pulled by the winch, the device turns into the middle (angled) offset portion of the chimney while keeping the spreader blade substantially perpendicular to the chimney walls, thus allowing the spreader blade to push repair/liner material into the chimney walls. The operator continues to pour repair material into the chimney so that the repair material completely covers the entire spreader blade even as the blade is angled perpendicular to the angled chimney walls. This typically requires enough repair material to provide a layer of six- to twelve inches above the lowermost portion of the spreader blade.

When the device begins to reach the second (upper) bend chimney offset, the top bow rods of the centering device will "turn" into the upper (vertical) offset portion before the lower rods of the pulling head reach the turn. Similarly, the lower pulling head rods will "turn" into the upper (vertical) offset portion before the spreader head portion of the assembly reaches the turn. As the cable continues to be pulled by the winch, the device turns into the upper (vertical) offset portion of the chimney while keeping the spreader blade substantially perpendicular to the chimney walls, thus allowing the spreader blade to push repair/liner material into the chimney walls.

In another method of use, a non-reticulated spreader assembly is inserted into the chimney, preferably from above, with the rods connected to a lower support plate. The upper ends of the rods are connected to a slidable connection on the cable, and the slidable connection is moved down on the cable to bow the rods outward until the bowed rods fill the chimney space. The upper ends of the rods are then clamped to the cable at that position, providing the "bullet" or "blowfish" shape that fits the dimensions of the chimney being repaired. The "sized" device is then lowered into the chimney, and may be pulled from below by a guide line. A winch is attached to the upper end of the cable.

As the device is being lowered, the guide wheel is held next to the cable and is lowered from above. The guide wheel is lowered until it is positioned just above the chimney offset, and the spreader continues downward until it is positioned near the bottom of the chimney below the offset. At this point the guide wheel holds the cable away from the chimney wall, preferably a distance about ⅔ of the way from the wall nearest to the direction of the offset to the wall farthest from the direction of the offset.

After the spreader assembly has been lowered to the bottom of the chimney, the spreader is first pulled upward for a short distance to ensure that the rim of the spreader blade is curled under. The repair material is then poured in from the top chimney opening. Sufficient material is provided to fill a space of six to eighteen inches above the spreader head. As previously indicated, it is important that there is enough material to provide at least about six inches or material to the highest part of the spreader blade when the spreader blade is angled to pass through an angled portion of a chimney offset. This provides sufficient head pressure to push the material over the spreader blade and onto the walls.

The spreader is then pulled upward to spread the material on the sides of the chimney below the offset. As the spreader approaches the offset, the guide wheel holds the cable away from the wall so that the cable and the spreader do not become snagged on the offset corner. As the centering device passes through the offset, the guide wheel is withdrawn and the spreader continues until it has passed completely through the offset.

As indicated above, the inventive tool may be used to reline a chimney, or to apply virtually any material to the interior surface of a chimney. The same basic method is applied, with the spreader being lowered to the bottom of a chimney and a flowable material being poured in from above. When the spreader is pulled up the material is spread on the insider surface of the chimney.

7. Reference to the Drawings.

Referring now to the drawings, FIG. 1 shows one preferred embodiment of the inventive spreader device. The illustrated device 10 includes a spreader assembly 40 and a centering device 50. Spreader assembly includes a spreader blade 41, a spreader head 42, and a lower support 43. Spreader blade 41 includes a foam blade portion 41*a* made of open cell foam, and a cover 41*b* made of vinyl. Centering device 50 includes a pull chain 60 and two reticulated portions 61 and 62.

The spreader blade of FIG. 1 is sandwiched between spreader head 42 and lower support 43. Spreader head 42 slopes downward from its highest point about two or three inches above the center of the device to its lowest point at its outside edges. When the repair/lining material is dropped down onto the spreader assembly from above, the shape of the spreader head helps direct material down and to the sides of the assembly. Foam support 43 is below and supports spreader blade 41.

An upper plate 46 supports spreader head 42. The illustrated upper plate 46 is made of a rigid material such as 10 gauge steel, and is sized to be slightly smaller than the outside edge of spreader head 42 to avoid catching on uneven sections of the chimney. Upper plate 46 also provides a surface for connection of rod or eye bolt 52 that is attached to the cable that pulls the device up through the chimney. In the illustrated embodiment the attachment to the cable is indirect, through chain 60 and rings 51 and 58.

Similarly, a lower plate 48 may be used to support lower foam support 43. In the illustrated embodiment lower plate 48 is made of a relatively rigid material such as plastic, and is connected to upper plate 46 by a pair of rods 54 that are held to plate 48 by nuts 55.

The centering device of FIG. 1 is a reticulated centering device positioned above the spreader assembly. Centering device 50 includes a pull chain 60 spanning two reticulated portions 61 and 62. Upper reticulated portion 61 is the upper centering guide and comprises four upper bow rods sized and positioned to bow outward and be guided by the corners of the chimney walls. Lower reticulated portion 62 is the lower centering guide and comprises a pair of header rods aligned to be parallel with two sides of the spreader assembly (and perpendicular to the two other sides).

In the illustrated device it can be seen that the lower set of centering rods is connected to the spreader head so that the lower portion of the centering device remains aligned with the spreader head, as described above. Accordingly, lower centering axis "L" is defined by the alignment of lower rods 62 with spreader head 41. Upper centering axis "U" is defined by upper rods 61. Upper centering rods 61 are reticulated with respect to lower rods 62 and spreader head 41, so that upper centering axis "U" may be angled (as opposed to being aligned) with respect to lower centering axis "L." This allows upper rods 61 to turn a corner in a chimney offset before lower rods 62 have reached that corner, thus allowing the spreader head to stay substantially perpendicular to the walls of the chimney even as upper rods 61 pass through a chimney offset bend.

Pull chain 60 includes connection rings 51 and 58 at its ends. Connection ring 51 is connected to spreader head 42 through jump ring 53 and eye bolt 52.

Figure 2A:
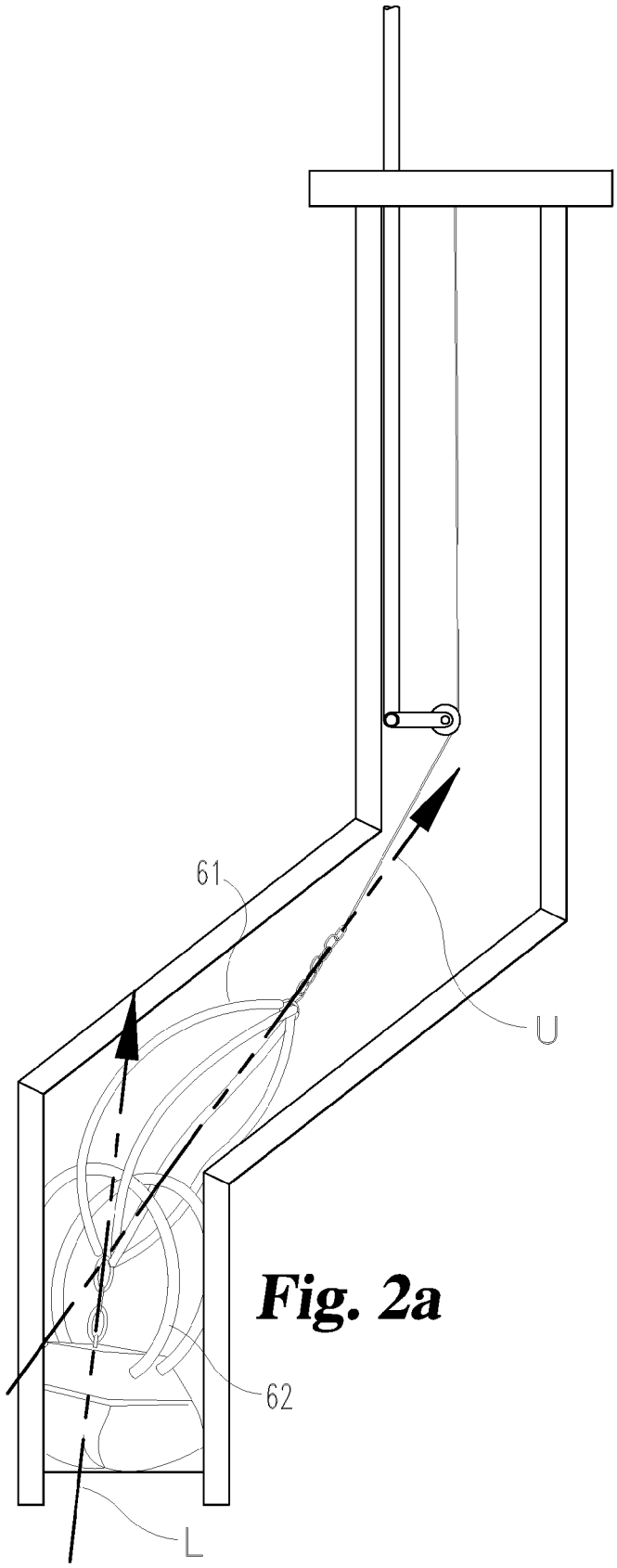
FIGS. 2A-2F show one preferred embodiment of the inventive spreader device as it moves through a chimney offset.
Figure 2B:
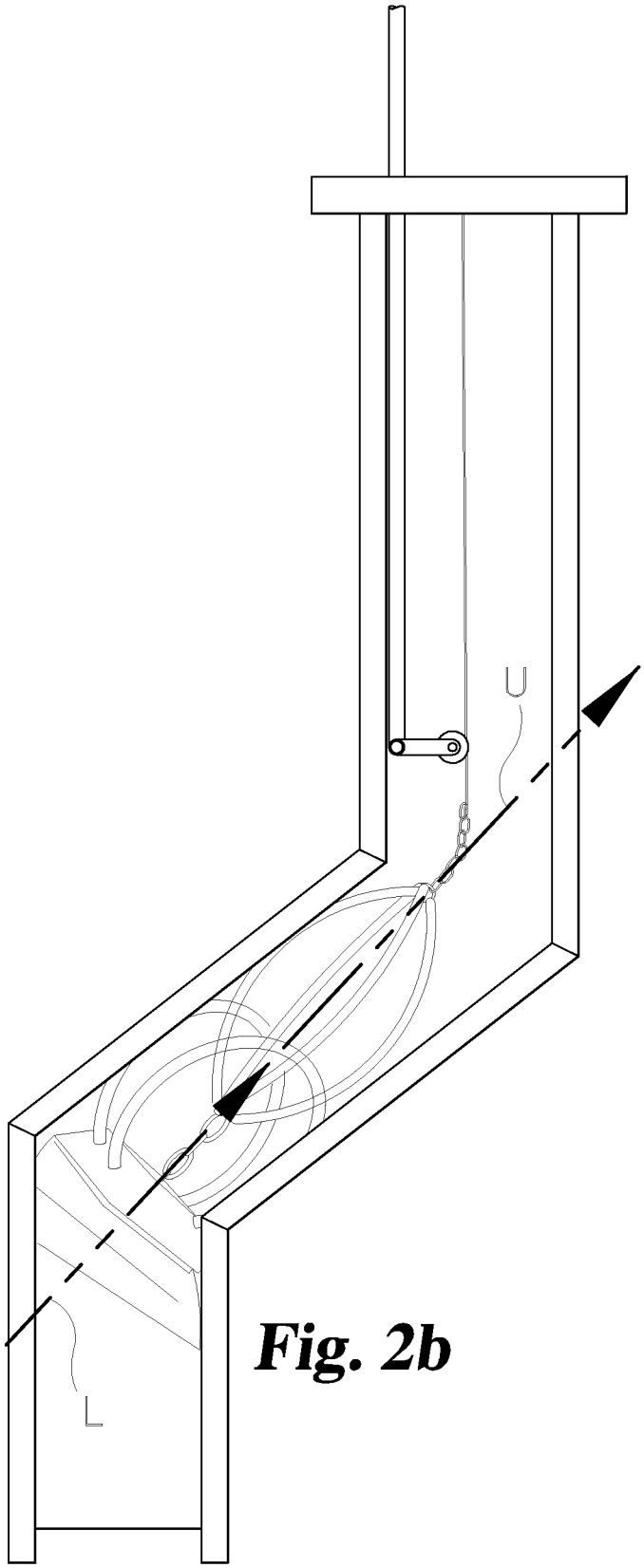
Figure 2C:
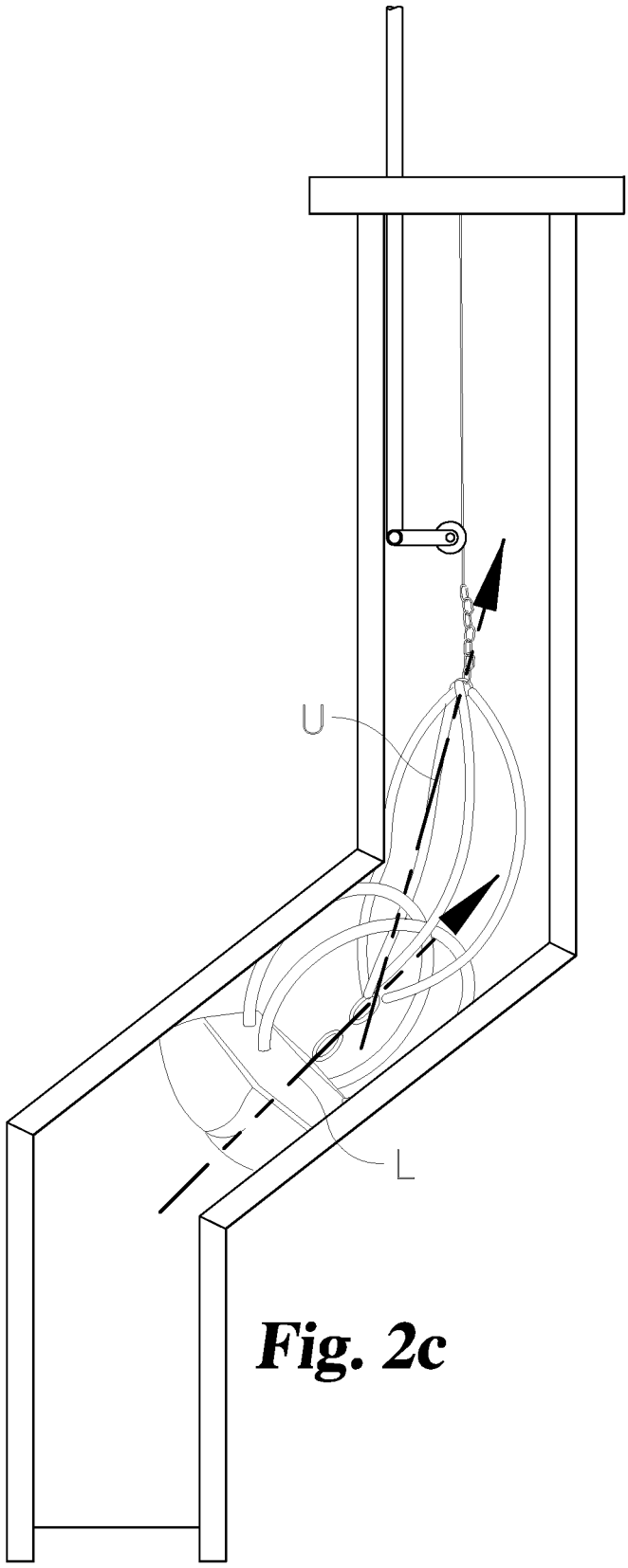

FIGS. 2A-2C show device 10 as it is being pulled upward through the middle (angled) portion of a double offset chimney. In FIG. 2A, the spreader blade and head are positioned in a chimney below the first bend of a double offset, and the reticulating centering device is beginning to turn into the first (lower) bend. In FIG. 2B, the spreader blade and head are just beginning to make the first turn of a double offset, and the reticulating centering device is centered in the middle, angled portion of the offset. In FIG. 2C, the spreader blade and head are positioned in the middle, angled portion of the offset, and the reticulating centering device is in the process of making the second (upper) turn.

Throughout the process, the spreader blade maintains a generally perpendicular position with respect to the chimney walls.

In FIG. 2*a*, lower centering axis "L" remains aligned with spreader head 41, while upper centering axis "U" is angled with respect to lower centering axis "L" This allows upper rods 61 to turn the corner in the chimney offset before lower rods 62 have reached that corner.

In FIG. 2*b*, lower centering axis "L" has re-aligned with upper centering axis "U" as the device completes its turn of the corner in the chimney offset.

In FIG. 2*c*, lower centering axis "L" remains aligned with spreader head 41, while upper centering axis "U" is angled with respect to lower centering axis "L" as the device begins another turn. Upper rods 61 have begun to turn the second corner in the chimney offset while lower rods 62 remain aligned with the spreader head which has not yet reached that corner.

Figure 2D:
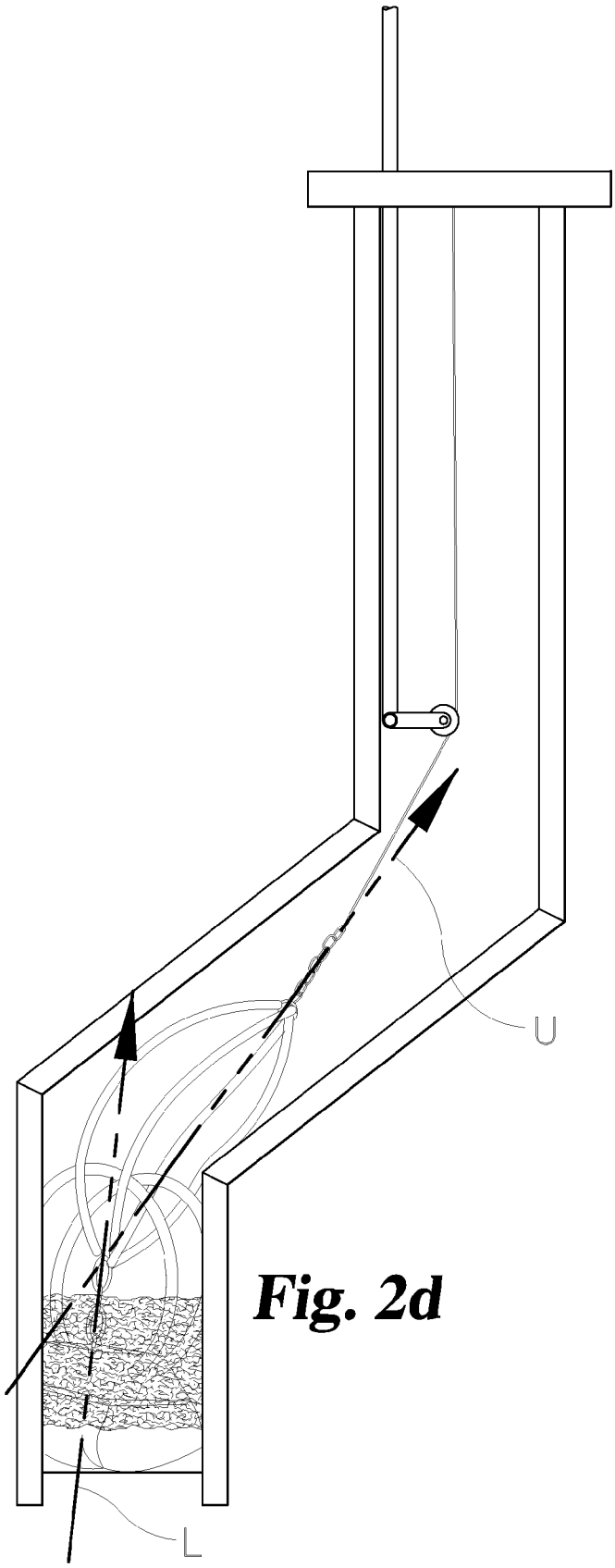
Figure 2E:
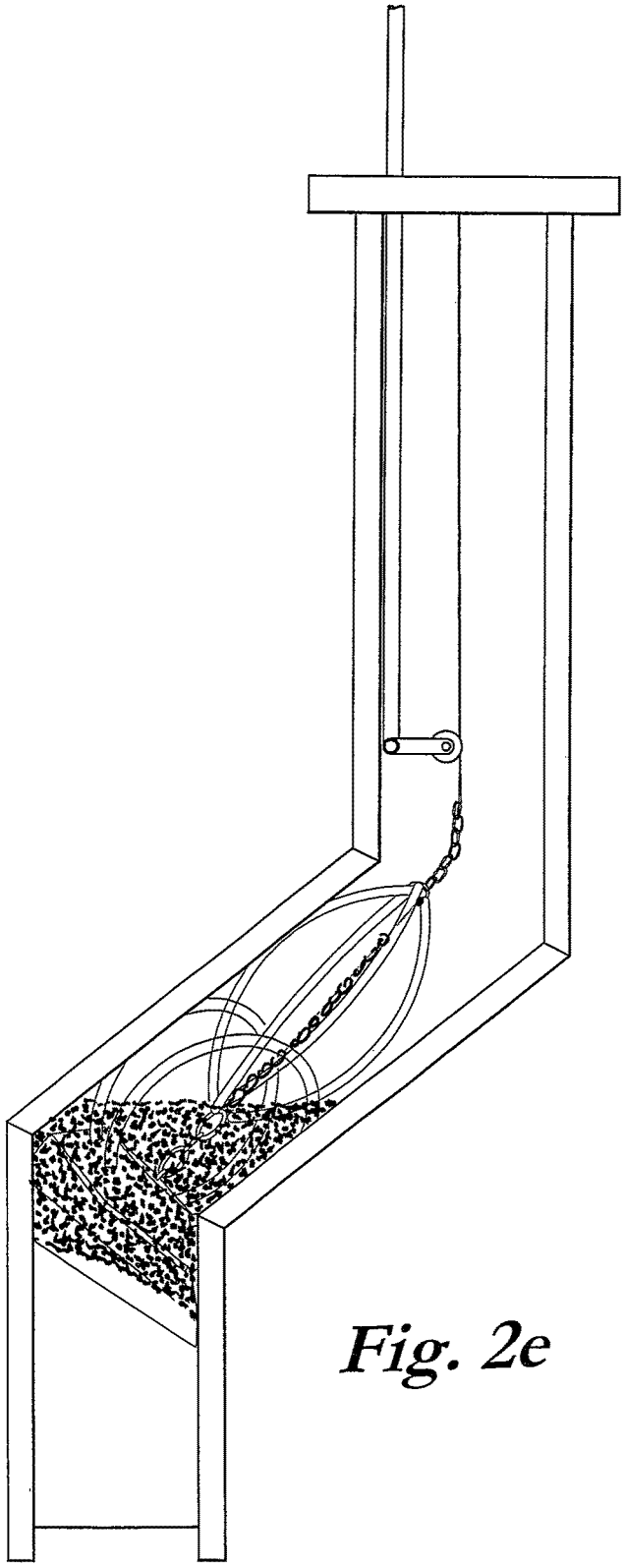
Figure 2F:
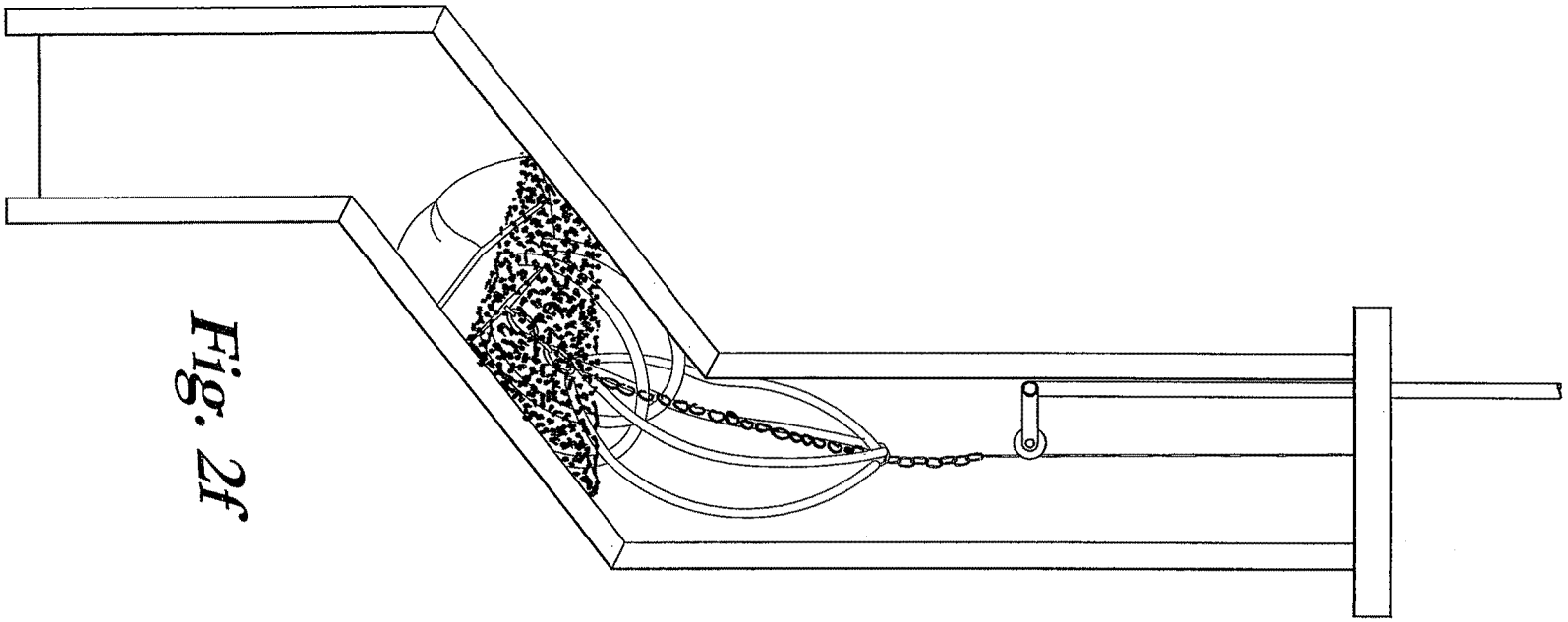

FIGS. 2D-2F show views 2A-2C with the repair material flowing down over the spreader head. In FIG. 2D, the spreader blade and head are positioned in a chimney below the first bend of a double offset, and the flowable repair material is provided to a depth of about six to twelve inches above the spreader blade. In FIG. 2E, the spreader blade and head are just beginning to make the first turn of a double offset, and the flowable repair material fills the bend to a depth of about six to twelve inches above the lowermost portion of the spreader blade. In FIG. 2F, the spreader blade and head are positioned in the middle, angled portion of the offset, and the reticulating centering device is in the process of making the second (upper) turn. Here too, the flowable repair material fills the bend to a depth of about six to twelve inches above the lowermost portion of the spreader blade. Throughout the process, the spreader blade maintains a generally perpendicular position with respect to the chimney walls.

Figure 3:
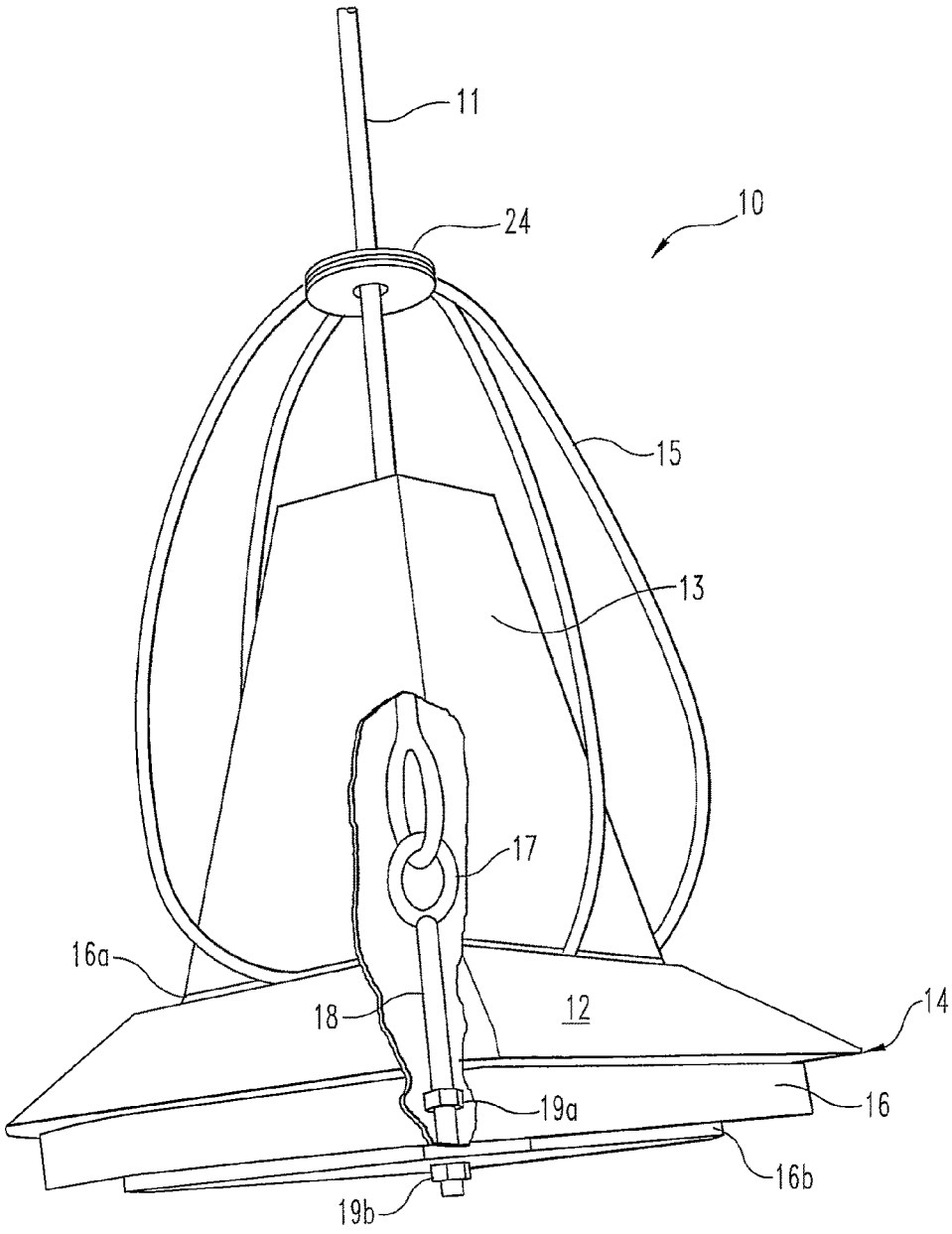
FIG. 3 shows another embodiment of the inventive spreader device, without the guide wheel portion.

FIG. 3 shows another preferred embodiment of the inventive spreader device without the guide wheel portion. Device 10 includes a cable 11 that pulls spreader blade 12. In the illustrated device, spreader blade assembly 12 includes upper blade 12*a* and lower spreader blade 12*b*. Cable 11 is attached to eye bolt 17 that connects to spreader support plate assembly 16*a* and 16*b* with bolt shank 18. Nuts 19*a* and 19*b* may be used to lock bolt 18 to upper support plate 16*a* and/or lower support plate 16*b*.

Spreader head 13 is positioned above spreader blade 12 to help direct repair material toward the rim 14 of the spreader blade.

The centering device of device 10 includes four centering rods 15, although a smaller or greater number of rods may be used. The lower ends of centering rods 15 attach to upper plate 16*a*, and the upper ends of the rods attach to clamp 24. When the rods are clamped in place the height of the centering device cannot expand or collapse during use.

Figure 4:
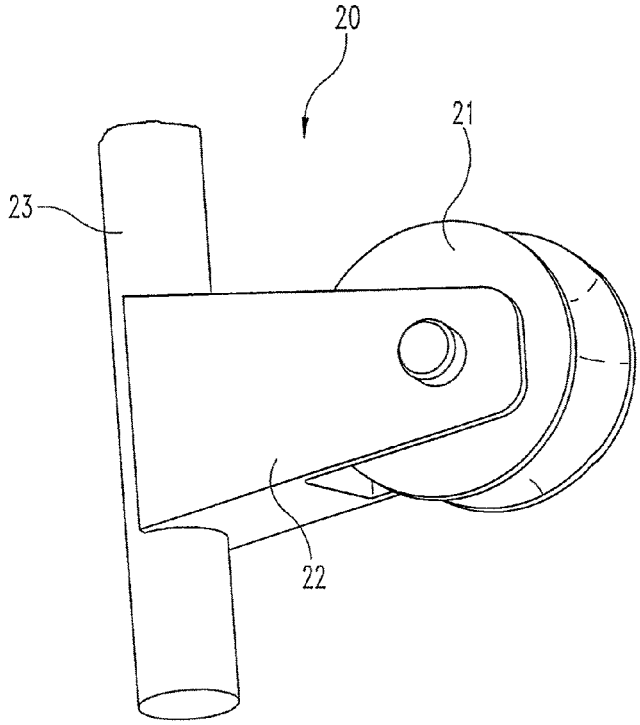
FIG. 4 shows a guide wheel for use with the inventive spreader device, according to one preferred embodiment.

FIG. 4 shows one embodiment of the guide wheel device that facilitates maneuvering and using the inventive spreader assembly. Guide wheel device 20 includes wheel 21, short extension arm 22, and rod 23.

Figure 5:
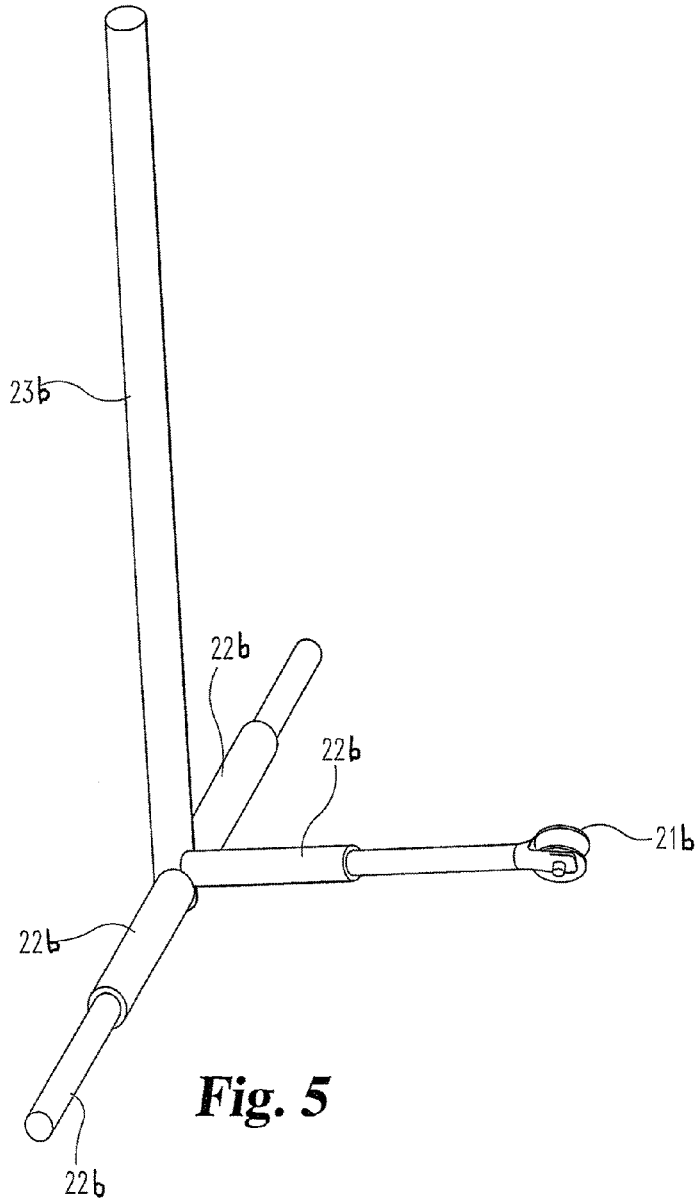
FIG. 5 shows a guide wheel and rod for use with the inventive spreader device, including the stabilizing arms and an extender arm.

FIG. 5 shows another embodiment of the guide wheel device of the inventive device. Guide wheel device 20*b* includes wheel 21*b*, extension arm 22*b*, stabilizing arms 24*b*, and rod 23*b*.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A device for repairing or relining an offset chimney, comprising:

a) a spreader assembly comprising a spreader blade configured to spread a chimney repair material over the inner wall of a chimney as the spreader blade is pulled through the chimney;

b) a pull assembly extending upward from the top of said spreader blade for a distance of at least 12 inches, said pull assembly being connected at an upper end to a device effective for pulling the spreader blade assembly upward through a chimney when the spreader blade is loaded with a repair material, and being connected at a lower end to said spreader assembly; and c) a reticulated centering device for keeping the pull assembly centered in the chimney when the spreader assembly is moved through a chimney offset; said reticulated centering device having an upper portion comprising a first plurality of rods and defining an upper centering guide, wherein each of said first plurality of rods has a first end connected to an upper portion of said pull assembly, and a second end connected to a lower portion of said pull assembly, and a lower portion of reticulated centering device comprising a second plurality of rods and defining a lower centering guide, wherein each of said second plurality of rods has a first end connected to said spreader blade, and a second end connected to said spreader blade, with said first plurality of rods at least partially overlapping said second plurality of rods; wherein said upper portion and said lower portion are reticulated with respect to each other such that upper centering guide may be angled with respect to lower centering guide, thus allowing the upper set of rods to begin turning in a bend in a chimney offset before the lower set of rods begins turning in that bend.

2. The device of claim 1 wherein said spreader assembly comprises a spreader blade having a rim configured to spread a chimney repair material over the inner walls of a chimney, and a spreader head configured to direct chimney repair material to the rim of the spreader blade.

3. The device of claim 1 wherein the upper portion of said reticulated centering device comprises four rods, and the lower portion of said reticulated centering device comprises two rods.

4. The device of claim 1 wherein the spreader blade comprises a flexible, open cell foam covered with a vinyl wrap.

* * * * *